United States Patent [19]

True

[11] Patent Number: 4,593,230

[45] Date of Patent: Jun. 3, 1986

[54] DUAL-MODE ELECTRON GUN

[75] Inventor: Richard B. True, Sunnyvale, Calif.

[73] Assignee: Litton Systems, Inc., Beverly Hills, Calif.

[21] Appl. No.: 362,790

[22] Filed: Mar. 29, 1982

[51] Int. Cl.[4] ..... H01J 29/48; H01J 1/46; H01J 29/46

[52] U.S. Cl. ..... 315/14; 313/349; 313/454

[58] Field of Search ..... 313/348, 349, 454; 315/3.5, 5.37, 14, 31 R

[56] References Cited

U.S. PATENT DOCUMENTS

| | | | |
|---|---|---|---|
| 3,484,645 | 12/1969 | Drees | 313/349 |
| 3,859,552 | 1/1975 | Hechtel | 313/449 |
| 3,903,450 | 9/1975 | Forbess et al. | 315/31 R |
| 4,165,473 | 8/1979 | Falce | 313/346 R |
| 4,471,267 | 9/1984 | Amboss | 315/3.5 |

OTHER PUBLICATIONS

Richard True, *An Ultra-Laminer Tetrode Gun for High Duty Cycle Applications,* Dec. 1979, IEDM presented in Wash. D.C., USA, pp. 286–289.

*Primary Examiner*—Theodore M. Blum
*Assistant Examiner*—Gilberto Barrón, Jr.
*Attorney, Agent, or Firm*—Poms, Smith, Lande & Rose

[57] ABSTRACT

An improved dual-mode electron gun includes a close-in and a further control grid to control the laminar flow of electrons which pass from the smooth spherical surface of a cathode toward an annular anode. In the high mode of operation, the close-in grid is maintained, for example, at +36 volts while the further grid is maintained at +250 volts. During the low mode of operation, the close-in grid is maintained at −36 volts while the further grid potential is +250 volts. The two control grids are divided into inner circular and an outer annular areas. The close-in grid has more conductive elements in its outer annular area than in the same area of the further grid. The two grids are then aligned so that the close-in grid functions as a control grid to block the flow of electrons from the outer annular area during the low mode of operation and as a shadow grid for the further control grid during both low and high modes of operation.

17 Claims, 10 Drawing Figures

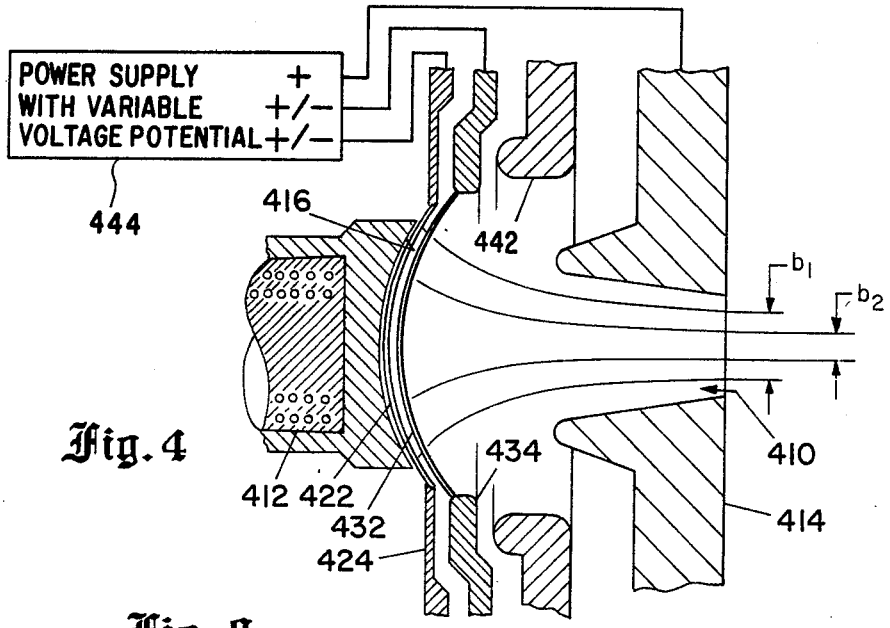
Fig. 4
Fig. 9 PRIOR ART
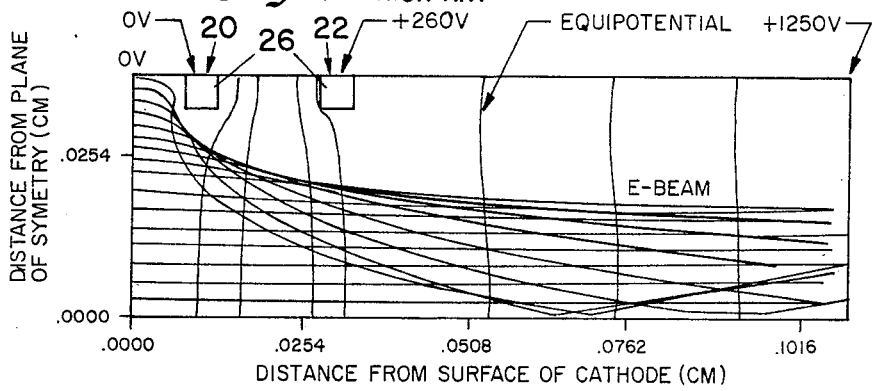
Fig. 10
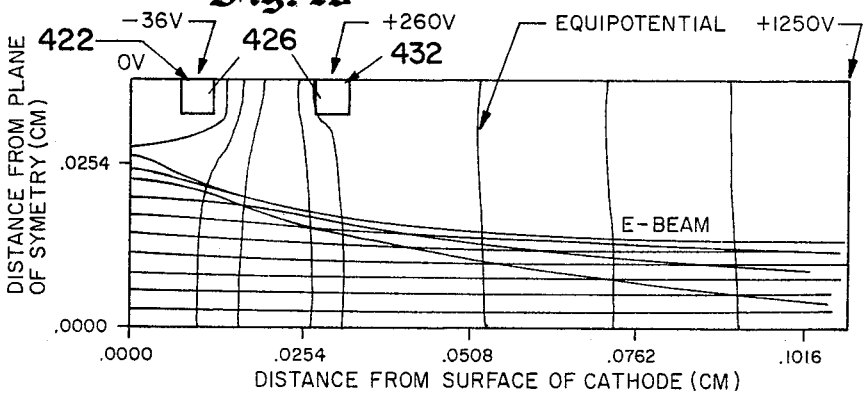

CLOSE-IN GRID

FURTHER GRID

DUAL-MODE ELECTRON GUN

The present invention relates to an improved dual-mode electron gun and, more particularly, to a grid system which improves the laminar flow of electrons utilizing closer-in and further control grids mounted in separate concentric spherical surfaces generally parallel to a spherical cathode.

BACKGROUND OF THE INVENTION

It is well known in the art to utilize a dual-mode electron gun within a travelling-wave tube (TWT) or a similar transient time tube. A travelling-wave tube is a broad-band, microwave tube which depends for its characteristics upon the interaction between the field of a wave propagated along a slow wave structure and a beam of electrons travelling with the wave. In this tube, the electrons in the beam travel with velocities slightly greater than that of the wave, and, on the average, are slowed down by the field of the wave. Thus, the loss in kinetic energy of the electrons appears as an increased energy conveyed by the field to the wave. The travelling-wave tube, therefore, acts as an amplifier or an oscillator.

In modern microwave radar, communications and electronic countermeasures systems, it is often desirable or necessary for the travelling wave tubes in these systems to operate at two different power levels. In one mode, the so-called low mode, the tube peak output power is at a level of $P_o$ watts, with a duty cycle of $D_u$, which can be 100% in the continuous wave case. In the so-called high mode in a 10 dB up-pulse device, the peak output power is 10 $P_o$ watts whereas the duty cycle is reduced to 0.1 $D_u$ so as to keep the average power level from the device approximately the same in both modes. The numbers quoted here are examples only. Other combinations of duty cycle and tube output power levels may be preferable in certain systems including more than two discrete levels of power and duty cycle.

An example of a dual-gridded electron gun which utilizes a screen grid projected over only a peripheral portion of an electron emissive cathode surface in combination with a second control grid which extends substantially across the full emissive surface is shown in U.S. Pat. No. 3,903,450, issued Sept. 2, 1975, by R. A. Forbess, et al.

The flow of electron current from the smooth surface of a cathode around the screen grid produces a non-laminar flow of electrons which has been avoided by the creation of dimples or grooves in the surface of the cathode. It then becomes necessary to align the screen grid with the dimples so that the raised edges between the dimples coincide with the conductive elements within the grid. An example of a gridded electron gun utilizing a dimpled cathode may be found in U.S. Pat. No. 3,843,902, issued Oct. 22, 1974, by G. V. Miram, et al.

Other arrangements aimed at improving the laminar flow of electrons within a dual-mode electron gun may be found in U.S. Pat. No. 3,859,552, issued Jan. 7, 1975, by R. Hechtel and in U.S. Pat. No. 4,023,061, issued May 10, 1977, by A. E. Berwick, et al. Each of these devices incorporate a first partial inner grid formed by a circular pattern of conductive elements which are surrounded by a second partial outer grid in the pattern of an annular ring of conductive elements which surround the circular pattern of the first partial inner grid. The first grid having the inner circular pattern is crimped so that the circular pattern fits into and aligns with the annular pattern of the second outer grid. The crimp arrangement permits the two grids to be aligned within a single spherical surface. However, the crimp creates discontinuity which distorts the laminar flow of electron current.

A typical prior art device incorporating the features mentioned above includes a scalloped or dimpled cathode having a shadow grid and two control grids including a first grid having an inner circular pattern of conductive elements with crimped or kinked radial supports to fit into and spherically align with a second grid having an outer annular pattern of conductive elements. As mentioned above, the scalloped cathode is required to compensate against field distortion caused by the use of a third shadow grid. The shadow grid, on the other hand, is required to prevent the heating of the first and second grids by the electron beam emanating from the cathode. The typical prior art gun is difficult to align since the ridges formed in the scalloped cathode must align with the shadow grid and with the first and second grids. Further, the crimp or kink within the first grid causes a non-laminar flow of electrons.

SUMMARY OF THE INVENTION

Accordingly, it is an object of the present invention to eliminate the dimpled or scalloped cathode often used within an electron gun.

Another object of this invention is to provide an improved dual-mode electron gun in which the heating of the control grids is reduced, thus permitting the elimination of the shadow grid.

A further object of the present invention is to provide an improved dual-mode electron gun in which alignment of the control grids is simplified.

In accomplishing these and other objects, there is provided an improved electron gun having a smooth surfaced, small diameter cathode disposed in juxtaposition with an anode between which is located two control grids. The first grid is close-in to the cathode and represents a very dense intercepting grid in the outer annulus where the major portion of the high mode electron current emerges during that phase of the dual-mode operation. The first, close-in control grid is also provided with an inner circular region of conductive elements of low density. A second control grid further from the first is provided with inner circular and outer annular regions of low density conductive elements which match the low density conductive elements found within the close-in control grid and which align themselves therewith.

During the high mode operation of the dual-mode electron gun, the close-in control grid and the further control grid are each operated at a positive potential wherein the gun is essentially a triode gridded gun in the outer annular region and a tetrode gridded gun in the inner circular region. During the low mode of operation, the close-in grid is operated at a small negative potential while the further grid operates at the same high potential as before. In this configuration current from the outer annular region is completely suppressed by the close-in grid whereas in the inner circular region the gun is essentially a negative shadow gridded gun.

DESCRIPTION OF THE DRAWINGS

Further objects and advantages of the present invention will become apparent after consideration of the following specification when considered with the accompanying drawings, wherein:

FIG. 4 is a cross-sectional view of the dual-mode electron gun of the present invention;

FIG. 9 is a cross-sectional view of a small segment showing but two wires and illustrating the flow of electrons within a conventional shadow gridded electron gun; and FIG. 10 is a view similar to FIG. 9 showing the flow of electrons during the low mode of operation of the present invention.

DESCRIPTION OF THE PREFERRED EMBODIMENTS

Figure 1:
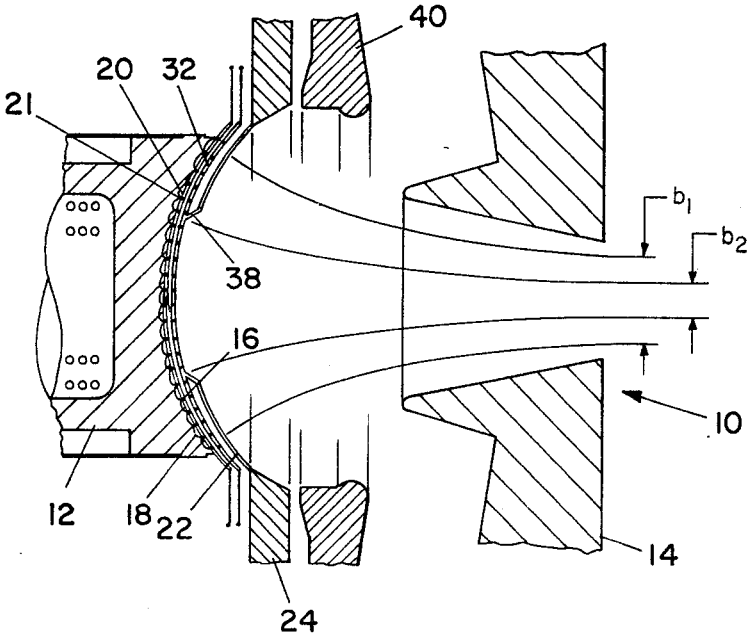
Fig. 1 PRIOR ART
FIG. 1 is a cross-sectional view of a dual-mode electron gun representing the prior art.

Referring now to the drawings, FIG. 1 shows an electron gun 10 of the prior art including a cathode 12 and an anode 14. The thermionic cathode dispenser is provided with an electron-emitting spherical surface 16 which has been dimpled or scalloped at 18 to permit a laminar flow of electrons about the conductive elements of a shadow grid 20. Shadow grid 20 is comprised of a plurality of annularly arranged conductive elements 21 which are connected to the frame of the electron gun 10 by radial conductive elements, not shown. Each annular conductive element 21 is aligned with the raised edge found between the scallops 18 upon the spherical surface 16 of cathode 12.

Figure 2:
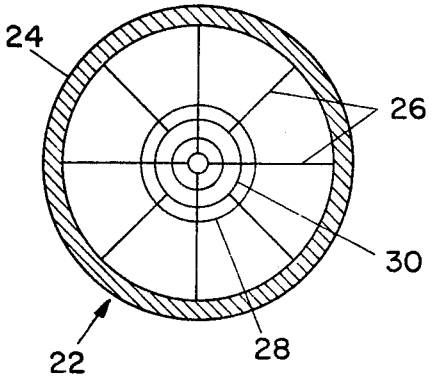
Fig. 2 PRIOR ART
FIG. 2 is a plane view of the first, inner control grid used in FIG. 1.

Beyond the shadow grid 20 is mounted an inner control grid 22, FIG. 2. The inner control grid includes an insulated mounting annulus 24 from which extends a plurality of radial conductors 26. An inner, circular grid 28 is formed by annular conductors 30 supported by the radial conductors 26. As assembled, the first inner control grid 22 is shaped with a spherical radius to enable it to mount concentrically with the spherical surface 16 of cathode 12. An outer control grid 32, FIG. 3, is formed in a similar manner to the inner control grid 22 having an annulus 34 that supports radial conductors 26 and annular conductors 30 which have been formed into an outer peripheral grid 36.

It will be noted in FIG. 1 that the radial conductors 26 which support the inner grid 28 have a crimp or a kink 38 to permit the inner grid 28 to be aligned within the same spherical surface as the outer peripheral grid 36. When assembling the dual-mode gun shown in FIG. 1, it is necessary to align the ridges between scallops 18 with the annular conductive elements 21 within the shadow grid 20 and further with the radial conductor 26 and the annular conductive elements 30 within the inner and outer control grids 22 and 32. While this alignment is accomplished in the prior art electron guns, it represents an assembly problem which adds to the cost of these guns.

A large annular focus electrode 40 is arranged between the control grids and the anode 14 to complete the dual-mode electron gun 10.

Figure 3:
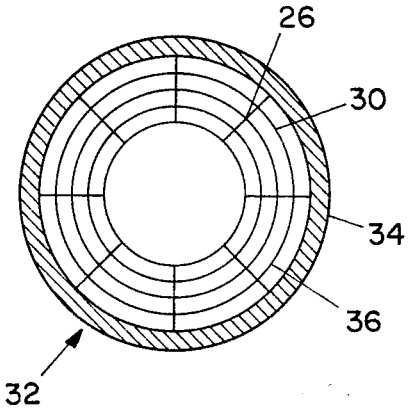
Fig. 3 PRIOR ART
FIG. 3 is a plane view of the second, outer control grid used in FIG. 1.

The prior art device shown in FIGS. 1–3 operates in the high mode by the application of a zero positive potential to the shadow grid 20 while a positive potential of 220 volts is applied to the inner and outer control grids, 22 and 32, respectively. In this arrangement, the shadow grid prevents the heating of these control grids. In the low mode of operation, a negative potential of 100 volts is applied to the outer control grid 32 while a positive potential of 220 volts is applied to the inner control grid 22.

When the proper alignment of the cathode, shadow screen and two grids has been acheived, a generally smooth or laminar flow of electrons will be had from the full surface 16 of the cathode 12, in the high mode, to generate a beam of electrons generally shown at "$b_1$". When a negative potential is applied to the outer control grid 32, the beam of electrons from the outer periphery of the cathode surface 16 is suppressed, thus limiting the beam in the low mode to the inner circle formed by inner control grid 28 and shown in FIG. 1 at "$b_2$".

While the prior art gun described in FIGS. 1–3 works when pr1operly aligned, it is desirable to improve this gun by reducing its manufacturing time and cost, reducing the rejection rate, and improving the operating characteristics. The present invention described in FIGS. 4–7 eliminates the required scallops 18 in the cathode surface 16, eliminates the need for the shadow grid 20, and eliminates the requirement of aligning the scalloped cathode surface with the shadow grid and the inner and outer control grids 22 and 32. The present invention also eliminates the need for the kink 38 in the radial conductors 26 of the inner control grid 22.

As seen in FIG. 4, an electron gun 410 of the present invention is provided with a cathode 412 and an anode 414, wherein the surface 416 of the cathode 412 is a smooth, spherical surface. A first, close-in control grid 422 is mounted adjacent the smooth spherically radiused surface 416 within a mounting annulus 424.

Figure 5:
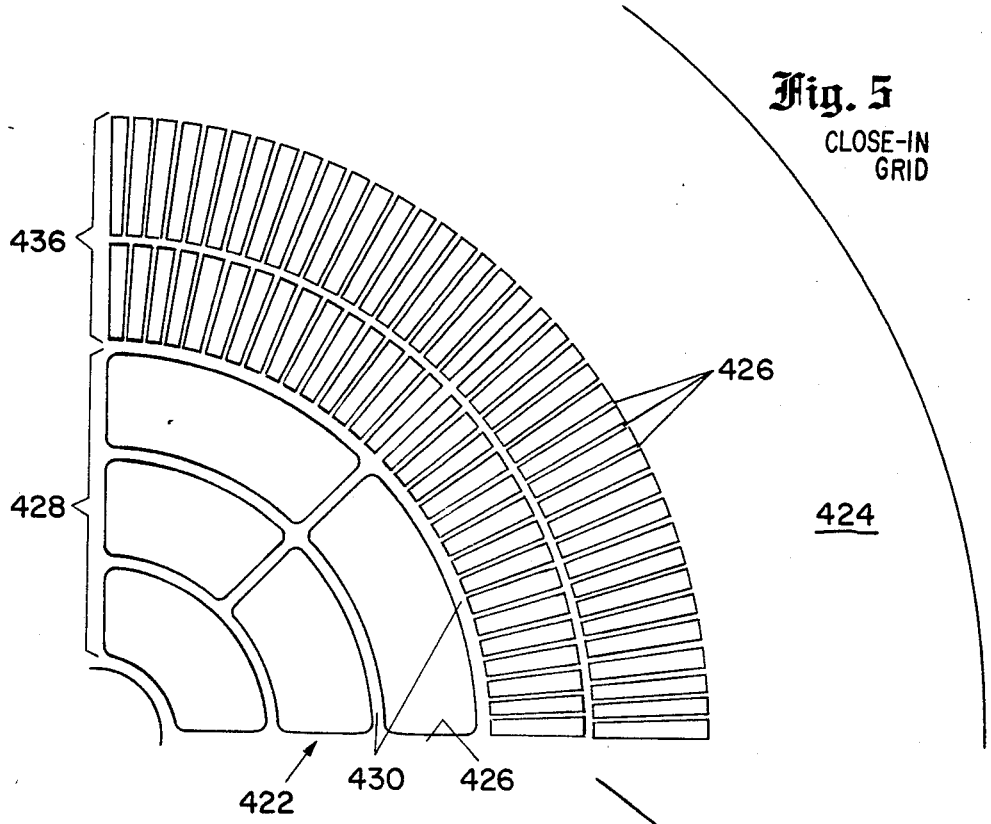
FIG. 5 is a plane view showing only one quadrant of the first, close-in grid utilized in the present invention.

A preferred embodiment of the close-in control grid 422 is shown in FIG. 5. The control grid is formed by photoetching or electrical discharge machining a formed thin sheet of molybdenum, hafnium, or an alloy of copper and zirconium sold under the trade name of Amzirc. The close-in grid is but 0.002 inches thick. While FIG. 5 shows but one quadrant of the close-in control grid 422, it will be understood that the grid has the same configuration in the remaining three quadrants not shown. To simplify the illustrations of FIGS. 5 and 6, the perimeter of the single quadrant shown has been omitted. Radiating inwardly from the annulus 424 are a plurality of radial conductors 426 which are supported by annular conductors 430. The first, close-in control grid is divided into two regions including an inner circular control grid region 428 and an outer annular control grid region 436.

In the preferred embodiment, the inner control grid region 428 is a circular pattern which consists of four annular conductors 430 which form three sets of openings or cells. The innermost set of cells include four openings within 360° formed by two of the annular conductors 430 and four radial conductors 426. Each set of the next two sets of concentric cells include eight cells within 360° formed by three annular conductors 430 and eight radial conductors 426. The inner control grid region 428 could be fabricated with an annular shape; however, a circular shape is preferred. The outer control grid region 436 is formed by two sets of cells including 120 cells in the innermost set and 152 cells in the outer set. Clearly the form of the inner and outer grid regions 428 and 436 and the number of cells and the configuration thereof may be varied to meet the configuration of a particular electron gun without departing from the teachings of this invention.

Figure 6:
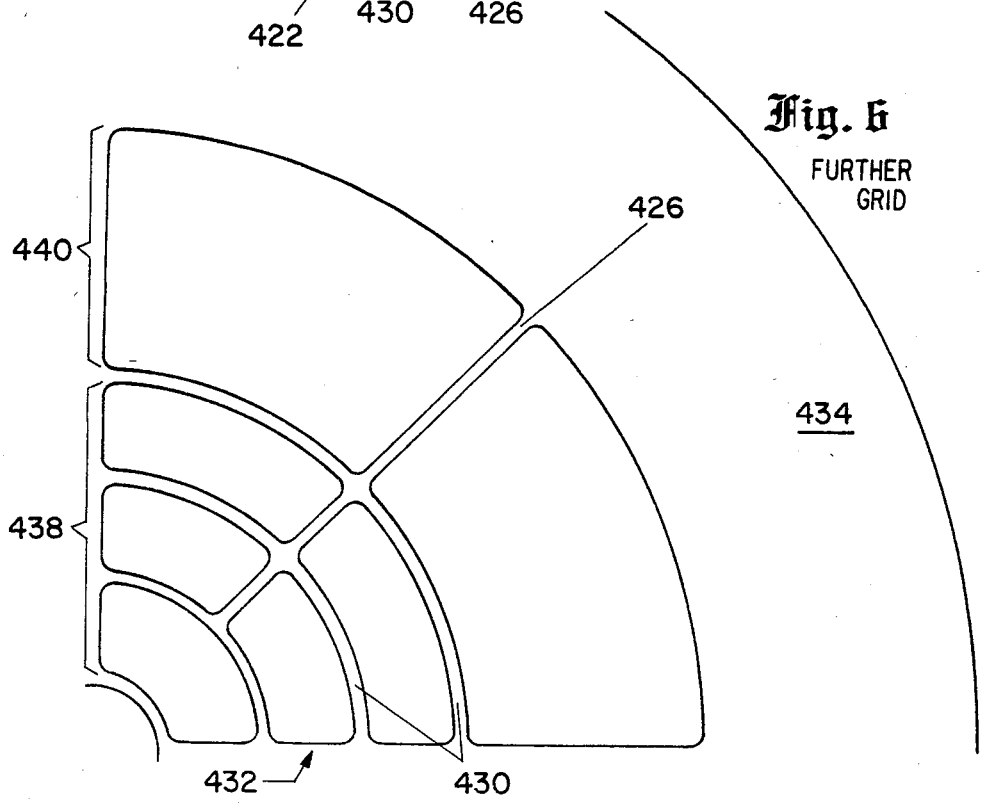
FIG. 6 is a plane view showing only one quadrant of the second, further control grid utilized within the present invention.

Located beyond the close-in control grid 422 is a second, further control grid 432, one quadrant of which is shown in FIG. 6. The further control grid 432 is formed from the same thin material as the close-in control grid except that, in the preferred embodiment, the material is 0.003 inches thick. The further control grid 432 is supported upon an annulus 434 and is concentrically arranged with a sperhical radius to substantially parallel the spherical shapes of control grid 422 and cathode surface 416. The further control grid 432 has an inner circular control grid region 438 and an outer annular control grid region 440. It will be noted that the inner control grid 438 is substantially identical in form to the inner control grid 428 of the close-in control grid 422. However, the outer control grid region 440 of grid 432 is merely a support structure formed by radial conductors 426 to support the annular conductors 430 which make up the inner control grid 438. One feature that is important in the present invention is that there must be radial and annular conductors in the close-in grid 422 which are identical to and aligned with the similar conductors in the further grid 432.

Reviewing FIGS. 4–6, it will be noted that the shadow grid has been eliminated as has the required scallops which are needed in order to prevent distortion caused by the shadow grid. Rather, the close-in grid 422 is placed very close to the surface 416 of the cathode 412. This grid is retained at a low voltage during the high and low modes of operation so that the grid functions as a shadow grid for the further grid 432. The utilization of vaned grids formed by the radial conductors 426 in the outer control grid 436 produces a more laminar flow of electrons than the concentric ring grids of the prior art shown in FIGS. 2 and 3. Further, the elimination of the kink 38 in the inner grid 22 also improves the laminar flow of electrons.

It is known that lower area convergence guns produce electron beams which are more laminar and easier to focus than high area convergence guns. Because of the very light level of cathode loading in the gun of the present invention, it is possible to use a cathode having a smaller diameter. A further reduction of the cathode diameter is possible through the use of a tungsten-iridium mixed metal matrix type of cathode which is capable of sustaining a higher cathode current density than a standard type B dispenser cathode.

The dual-mode electron gun of the present invention has been evaluated during the high mode of operation with voltage potentials of +36 volts on the close-in grid 422 and +250 volts on the further grid 432 at which time the width of the electron beam is the equivalent of the width shown in FIG. 4 at $b_1$. During the low mode of operation, when the width of the electron beam is $b_2$, the voltage applied to the close-in control grid 422 is −36 volts while the voltage on the further grid 432 is retained at +250 volts. A focusing electrode 442 located between the annulus 434 and the anode 414 serves to focus the beams, as is known in the art of electron gun design. However, in the present invention, the high and low mode beams may be each focused with the same magnetic field from a single electrode 442.

The present invention may be practiced at voltages other than those indicated above. Table 1, below, indicates the ranges of voltage potential which may be utilized within the improved dual-mode electron gun wherein the voltage $E_g$ across each control grid is expressed in volts and the current $I_g$ is expressed in amps. The range of voltage potentials applied to the grids 422 and 432 is as follows:

TABLE 1

| | High Mode | Low Mode | Cut Off |
|---|---|---|---|
| $E_g$ 422 (volts) | +20 to +50 | −20 to −50 | −20 to −50 |
| $I_g$ 422 (amps) | .54 to .75 | 0 | 0 |
| $E_g$ 432 (volts) | +150 to +400 | +150 to +400 | −150 to −400 |
| $I_g$ 432 (amps) | 0 to .075 | 0 | 0 |

If it is desired to cut off the dual-mode electron gun, a negative potential of 20 to 50 volts is applied to the close-in grid 422 while a negative potential of 150 to 400 volts is applied to the further grid 432. The unique configuration of the electron gun 410 permits an easy, quick and uniform cut off. A power supply capable of providing the variable potentials listed in Table 1 is shown schematically at 444 in FIG. 4.

Figure 7:
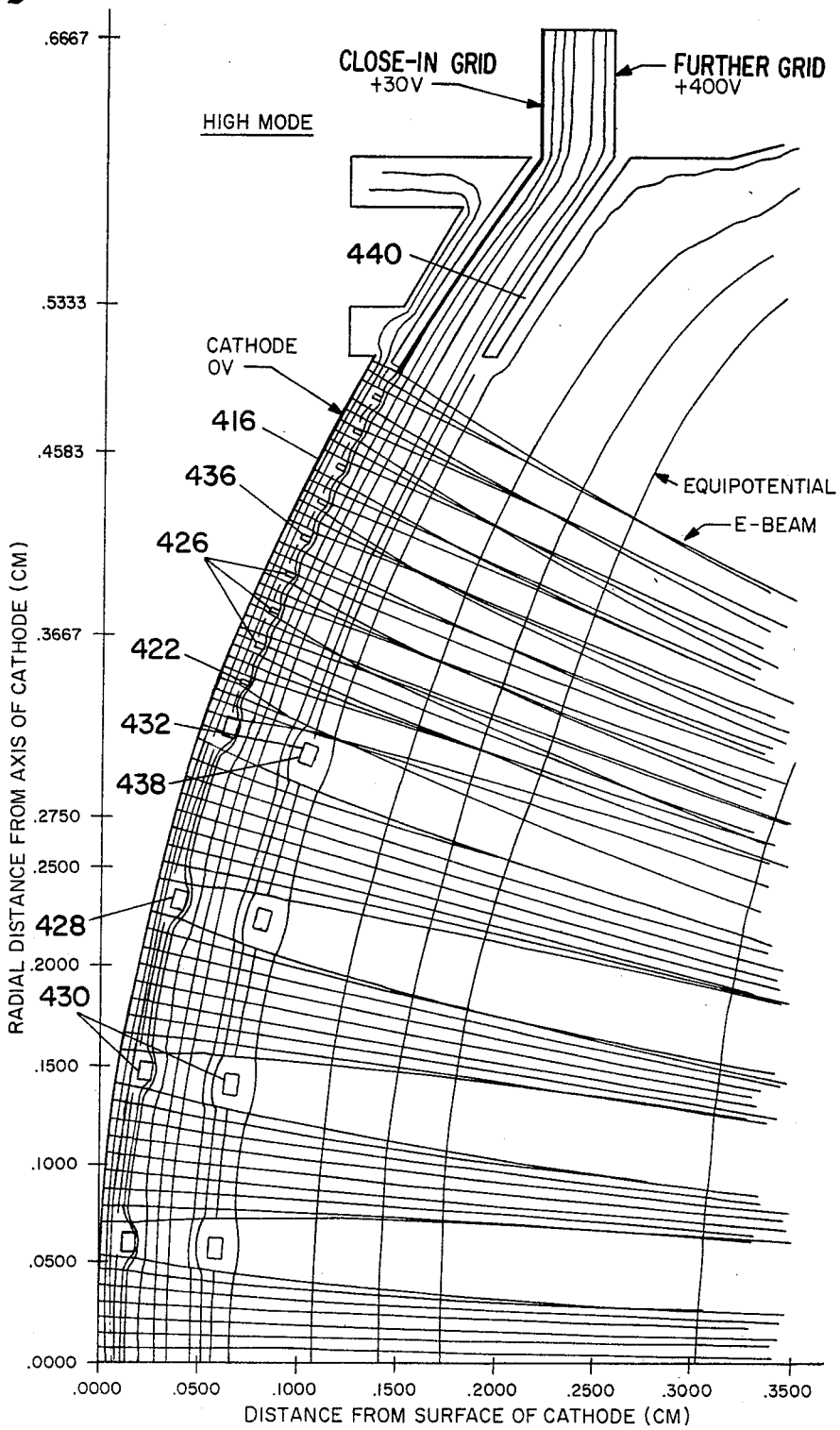
FIG. 7 is a cross-sectional view schematically illustrating the flow of an electron beam during the high mode of operation of the electron gun.

Referring now to FIG. 7, a diagram is shown which schematically illustrates the flow of an electron beam from the cathode surface 416 through the close-in grid 422 and the further grid 432 toward the anode 414 during the high mode of gun operation. In FIG. 7, the generally horizontal lines represent a computer plot of the electron current as the electrons flow from the cathode surface 416 toward the anode 414; while the vertical lines represent lines of equipotential. It will be noted how the inner region 428 of the close-in grid 422 functions as a shadow grid for the inner region 438 of the further grid 432. Also note that the outer region 436 of the close-in grid 422 is shown as if the radial conductors 426 had been rotated 90° to form annular conductors for the purpose of illustrating the flow of electrons. This rotation was done for the sake of computer modeling. While annular conductors may be used within the present invention, radial conductors are preferred as they produce a more laminar flow of electrons.

Figure 8:
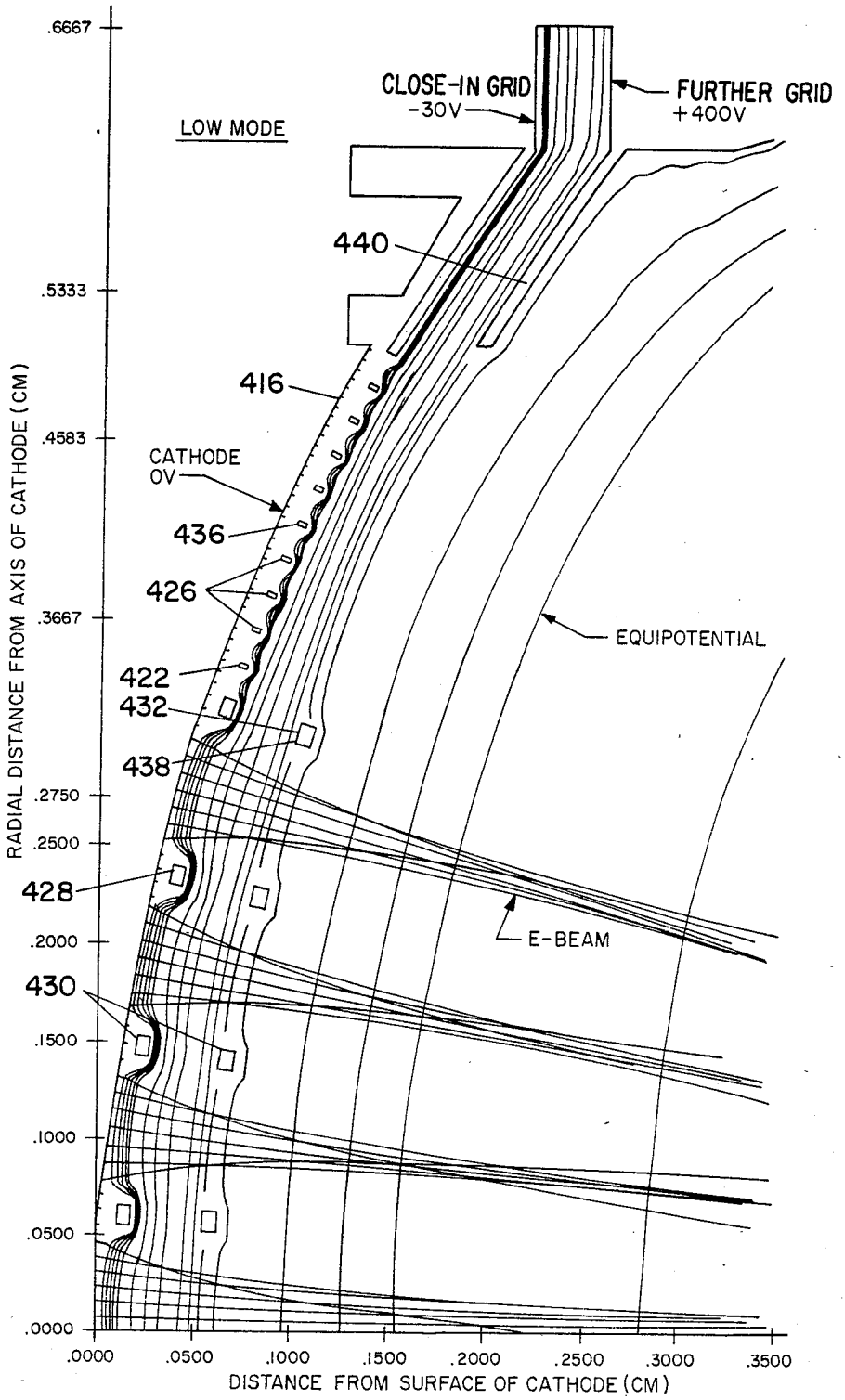
FIG. 8 is a cross-sectional view schematically illustrating the flow of an electron beam during the low mode of operation.

In FIG. 8, a computer plot similar to FIG. 7 is shown for the low mode of operation of the electron gun 410. Note how a small negative potential of 30 volts acts to block the flow of electrons from the outer peripheral area of the cathode surface 416 covered by the high density of conductors 426 within the outer grid 436 of close-in control grid 422.

Referring to FIG. 9, a computer plot similar to the plots of FIGS. 7 and 8 is shown except that the plot represents but a single radial conductor 26 found within a conventional shadow grid 20, FIG. 1, and a conventional inner or outer control grid, such as grids 22 or 32. It will be noted that the electrons flow toward the shadow grid 20 and its conductive wire 26 and are repelled from that wire back toward the cathode. As the electrons then continue past the control grid 22 and its conductive wire 26 they cross the paths of other electrons and pass out of FIG. 9, as shown. In the figure, the lines passing with a positive slope represent electrons from other adjacent wires 26 which have been deflected into the path shown here. Clearly, this diagram illustrates an electron flow which is less laminar than desirable. A similar plot to FIG. 9 may be found in FIG. 1 of a paper by the inventor of this invention, R. B. True, entitled "An Ultra-Laminar Tetrode Gun For High Duty Cycle Applications" which appears in the IEDM Technical Digest, 1979, at pages 286–289.

While the electron gun 410 was being examined, a more laminar flow than that shown in FIG. 9 was expected during the high mode of operation. However, it was also expected that a less laminar flow would be generated during the low mode of operation then the flow depicted for a conventional shadow gridded gun shown in FIG. 9. Unexpectedly, the flow pattern which resulted from using a slightly negative close-in control grid 422, eliminating the shadow grid and using a smooth cathode surface 416, was much better than that shown in FIG. 9. That is, the election flow about the slightly negative, close-in control grid 422 toward the positive further control grid 432 produced an electron flow which reduced the amount of current scattered by the close-in shadowing control grid resulting in a more laminar beam than that shown in FIG. 9.

The improved laminar flow of an electron gun using a slightly negative, close-in control grid 422 in place of a shadow grid and two control grids is shown in FIG. 10. Here, the radial conductor 426 of the first, close-in control grid 422 is at a negative potential of −36 volts while the radial conductor 426 of the second, further control grid 432 is at a potential of +260 volts. This unexpected improved laminar flow of electrons, represents a further improvement in the simplified dual-mode electron gun 410 of the present invention. When one considers that the electron gun 410 is operating at a potential difference between the cathode and anode of 25 and 35 KV, it will be understood why −20 to −50 volts is a small negative potential.

Another embodiment of the present invention may be formed by the utilization of more than two distinct regions for emission control. That is, the circular and annular regions of control grid 422, for example, may be varied continuously with the radial conductors 426 which form the inner circular grid 428 becoming closer and closer with each set as the sets move toward the outer periphery of the grid. It is then possible to produce an electron gun which produces a beam that can be shrunk in diameter as the voltage on grid 422 is made more negative. In this manner, a beam may be focused from a high-pulse mode continuously or in steps down to the low mode. This would be accomplished by varying the negative potential on grid 422 so that each set of radial conductors would block more of the peripheral surface of the cathode 416 as the negative potential is increased. As most electron guns possess a range of preverance where focusing is good, probably three regions would be sufficient, namely, a central region for the low mode, an intermediate annulus for an intermediate current level, and an outer annulus for the high mode, rather than the continuous grading alluded to above. Ideally, the voltage of the close-in grid 422 would be varied constantly or in steps downward from the high mode in going to the low mode and the voltage of the further grid 432 only switched to a negative bias for the cut off mode.

Another way of viewing the operation of the electron gun invention of FIGS. 4–6 is from the prospective of the number of grids controlling its operation. The electron gun, as described, operates in the high mode of dual-mode operation substantially as a triode gridded gun in the outer region and a tetrode in the inner region in the high mode of dual-mode operation. During the low mode of operation, the close-in control grid and further control grid, 422 and 432, respectively, operate as a negative shadow gridded gun in the inner grid regions 428 and 438.

I claim:

1. An improved electron gun for dual-mode operation, comprising:

a cathode having a spherical surface and an annular anode;

a first, close-in control grid located adjacent to said cathode having an inner and outer region formed by a pattern of conductive elements, said inner and outer regions covering the full surface of said cathode;

a second, further control grid located beyond said first, close-in control grid having an inner and outer region formed by a pattern of conductive elements;

means for establishing voltage potentials for said dual-mode operation including a high and low mode;

said conductive elements in said outer region of said first, close-in control grid being more spacially dense than said conductive elements in said outer region of said second, further control grid;

said conductive elements in said inner and outer regions of said second, further control grid formed with a pattern which is matched by said conductive elements in said first, close-in control grid and aligned, from said cathode, behind said conductive elements in said first, close-in control grid as to be blocked from said cathode by said first, close-in control grid; and means for establishing a negative voltage potential on said inner and outer regions of said first, close-in control grid during said low mode of operation wherein said first, close-in control grid acts as a shadow grid for said second, further control grid and improves the laminar flow of electrons from said cathode to said anode.

2. An improved electron gun for dual-mode operation, as claimed in claim 1, additionally comprising:

said inner regions of said first, close-in and said second, further control grids are circular regions; and said outer regions of said first, close-in and second, further control grids are annular regions.

3. An improved electron gun for dual-mode as claimed in claim 1, additionally comprising:

means for establishing a voltage potential of 25K volts to 35K volts between said cathode and said anode;

means for establishing a voltage potential of plus one hundred and fifty volts to plus four hundred volts on said second, further control grid during said high and low modes of dual operation;

means for establishing a voltage potential of minus twenty volts to minus fifty volts on said first, close-in control grid across the full face of said cathode during said low mode of dual operation; and means for establishing a voltage potential of plus twenty volts to plus fifty volts on said first, close-in cathode grid across the full face of said cathode during said high mode of dual operation.

4. An improved electron gun for dual-mode operation as claimed in claim 1, additionally comprising:

said first, close-in control grid and said second further control grid arranged in a separate spherical relationship which generally parallels one another and said spherical surface of said cathode;

said first, close-in control gird and said second, further control grid arranged in a spherical relationship which approximates surfaces of equipotential which correspond to the operational potentials of said grids in said high mode; and said first, close-in control grid and said second, further control grid having spherical radii of curvature which concentrically match the spherical radius of curvature of said cathode surface.

5. An improved electron gun for variable power operation, comprising:

means for establishing voltage potentials for said variable power operation;

a cathode having a smooth spherical surface;

an anode maintained at a higher potential than said cathode;

a close-in control grid mounted adjacent said cathode having a pattern of conductive elements forming an inner circular and an outer annular region;

a further control grid mounted beyond said close-in grid toward said anode having a pattern of conductive elements forming an inner circular and an outer annular region;

said pattern of conductive elements within said further control grid matched by said pattern of conductive elements within said close-in control grid and aligned therewith so that said pattern of said close-in control grid casts a shadow upon each conductive element of said further control grid;

said outer annular region of said close-in control grid having more conductive elements in the pattern thereof than said outer annular region of said further control grid;

said close-in and further control grids mounted in separate, spherical surfaces which generally parallel said cathode surface; and means for establishing a variable negative potential on said close-in control grid including said inner circular and outer annular region to improve laminar flow of electrons from said cathode to said anode.

6. An improved electron gun, as claimed in claim 5, additionally comprising:

said means for establishing voltage potentials including a high and low mode of dual-mode operation;

means for establishing a voltage potential of plus one hundred and fifty volts to plus four hundred volts on said further control grid during said high and low modes of dual-mode operation;

means for establishing a voltage potential of minus twenty volts to minus fifty volts on said close-in control grid during said low mode of dual-mode operation; and means for establishing a voltage potential of plus twenty volts to plus fifty volts on said close-in control grid during said high mode of dual-mode operation.

7. An improved electron gun, as claimed in claim 5, additionally comprising:

said means for establishing voltage potentials during said dual-mode of operation additionally including a cut off mode of operation;

means for establishing a voltage potential of minus twenty to minus fifty volts on said close-in control grid during said cut off mode of operation; and means for establishing a voltage potential of minus one hundred and fifty volts to minus four hundred volts to said further control grid during said cut off mode of operation.

8. An improved electron gun, as claimed in claim 5, additionally comprising:

said close-in control grid having a pattern of conductive elements whose density increases as said pattern moves toward the periphery of said close-in control grid; and means for establishing a variable voltage potential upon said close-in control grid to produce a variable mode electron gun.

9. An improved dual-mode electron gun, comprising:

a cathode having a spherical surface;

an anode;

means for establishing a potential for said dual-mode operation including a high and low mode;

a close-in control grid located adjacent to said cathode having an inner circular and outer annular region formed by a pattern of conductive elements, the combination of which covers the full spherical surface of said cathode;

said close-in control grid having more conductive elements in the pattern which forms its outer annular region than said conductive elements in the pattern which forms its inner circular region;

a further control grid located beyond said close-in control grid having an inner circular and outer annular region formed by a pattern of conductive elements the combination of which covers the full spherical surface of said cathode;

said conductive elements in said inner and outer regions of said further control grid formed with a pattern which is matched by said pattern of conductive elements in said close-in control grid, is aligned behind said conductive elements in said close-in control grid, and is blocked from said cathode by said close-in control grid, wherein said close-in control grid acts as a shadow grid for said further control grid; and means for establishing a negative potential upon said close-in control grid across the full surface of said cathode during said low mode of operation to improve the flow of electrons from said cathode to said anode.

10. An improved dual-mode electron gun, as claimed in claim 9, additionally comprising:

said close-in control grid having more conductive elements in the pattern which forms its outer annular region than said conductive elements in the pattern which forms the outer annular region of said further control grid.

11. An improved dual-mode electron gun, as claimed in claim 9, additionally comprising:

said spherical face of said cathode having a smooth spherical surface, and said close-in control grid and said further control grid having separate spherical surfaces generally concentric with and parallel to said spherical face of said cathode.

12. An improved dual-mode electron gun, as claimed in claim 9 wherein said means for establishing a potential include:

means for establishing a potential between said cathode and said anode;

means for placing small positive and negative potentials upon said close-in control grid compared to said cathode; and means for placing higher positive and negative potentials than said close-in control grid but small compared to said cathode, upon said further control grid.

13. An improved dual-mode electron gun, as claimed in claim 9, wherein said cathode is of the tungstuniridium mixed matrix type.

14. An improved dual-mode electron gun, as claimed in claim 9, wherein said close-in control grid and said further control grid are formed from a material selected from a group consisting of mobybdenum, hafnium, or an alloy of copper and zirconium.

15. An improved dual-mode electron gun, as claimed in claim 9, additionally comprising:

means for generating a focusing magnetic field located between said further control grid and said anode.

16. An improved dual-mode electron gun for operation in a high and low mode, comprising:

a cathode having an electron emitting surface;

and anode;

means for establishing potentials for said dual-mode operation, close-in control grid means formed of conductive elements in a first pattern mounted in isolation from and adjacent to said cathode for covering the full electron-emitting surface of said cathode;

further control grid means formed of conductive elements in a second pattern having fewer conductive elements than said first pattern mounted beyond said close-in control grid means for covering the full electron-emitting surface of said cathode;

said further control grid means aligned behind said close-in control grid means from said cathode, said close-in control grid means thus acting as a control grid and shadow grid for said further control grid means; and said means for establishing potentials including means for establishing a negative potential upon said close-in control grid means during said low mode of operation and for establishing a positive potential thereon during said high mode of operation.

17. An improved dual-mode electron gun, as claimed in claim 16, additionally comprising:

said close-in control grid means having an inner circular and an outer annular region formed by a first pattern of conductive elements;

said further control grid means having an inner circular and an outer annular region formed by a second pattern of conductive elements; and said first pattern containing more conductive elements than said second pattern, said second pattern being masked by said first pattern.

* * * * *